US008750770B2

(12) United States Patent
Fujita et al.

(10) Patent No.: US 8,750,770 B2
(45) Date of Patent: Jun. 10, 2014

(54) IMAGE FORMING METHOD AND IMAGE FORMING APPARATUS

(75) Inventors: Michiyo Fujita, Tokyo (JP); Tatsuya Nagase, Tokyo (JP); Asao Matsushima, Tokyo (JP); Yasuko Uchino, Tokyo (JP); Aya Shirai, Tokyo (JP); Ryuichi Hiramoto, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 181 days.

(21) Appl. No.: 13/338,667

(22) Filed: Dec. 28, 2011

(65) Prior Publication Data

US 2012/0177417 A1 Jul. 12, 2012

(30) Foreign Application Priority Data

Jan. 7, 2011 (JP) ..... 2011-001767

(51) Int. Cl.
*G03G 15/16* (2006.01)

(52) U.S. Cl.
CPC ..... *G03G 15/1625* (2013.01)
USPC ..... 399/297; 399/307; 399/168; 399/176

(58) Field of Classification Search
USPC ..... 399/297, 307, 168, 176
See application file for complete search history.

(56) References Cited

U.S. PATENT DOCUMENTS 6,229,982 B1 * 5/2001 Yamauchi et al. ..... 399/327

FOREIGN PATENT DOCUMENTS

| | | |
|---|---|---|
| JP | 01-200985 | 8/1989 |
| JP | 07-129013 | 5/1995 |
| JP | 09-001995 | 1/1997 |
| JP | 2000-015944 | 1/2000 |
| JP | 2000-127691 | 5/2000 |
| JP | 2007-015159 | 1/2007 |
| JP | 2008-108684 | 5/2008 |
| JP | 2008-122560 | 5/2008 |
| JP | 2009-090464 | 4/2009 |
| JP | 2010-282087 | 12/2010 |

OTHER PUBLICATIONS

Japanese Office Action, Patent Application No. 2011-001767, date mailed: Jan. 28, 2014.
English translation of Japanese Office Action, Patent Application No. 2011-001767, date mailed: Jan. 28, 2014.

* cited by examiner

*Primary Examiner* — Walter L Lindsay, Jr.
*Assistant Examiner* — Roy Y Yi
(74) *Attorney, Agent, or Firm* — Lucas & Mercanti, LLP

(57) ABSTRACT

Provided is an image forming method in which a foil image exhibiting excellent finish without any wrinkle and strong adhesive strength is formed on a foil transferring face made of toner. The image forming method for transferring the transfer foil on the foil transferring face is conducted by contacting the transfer foil to the foil transferring face formed by using toner having a glass transition temperature of not more than 60° C., and by passing through a nip portion formed between a driving roller and a follower roller.

13 Claims, 7 Drawing Sheets

IMAGE FORMING METHOD AND IMAGE FORMING APPARATUS

This application is based on Japanese Patent Application No. 2011-001767 filed on Jan. 7, 2011, in Japanese Patent Office, the entire content of which is hereby incorporated by reference.

TECHNICAL FIELD

The present invention relates to an image forming method and an image forming apparatus which forms a foil image on a base substance (an image supporting material) by forming a toner image area called a foil transferring face, followed by forming the foil image by transferring a foil on the foil transferring face by using an electrophotographic system.

BACKGROUND

In a field of bookbinding, a commercial printing, a card business or a plastic molding such as a cosmetic container, a printing processing treatment called "Foil stamping" is conducted. This treatment is also called "Hot stamp method" and by using a pressure bonding member called a metal stamper, a text or a picture made of a metallic foil is transferred to abase substance surface by heat and pressure, a metallic appearance or an expensive look can be achieved which cannot be expressed merely by common printing. Further, in recent years, a hologram is often attached on, for example, a cash card or a credit card in order to prevent falsification or alteration, or for the security of these cards. Such a hologram used for the prevention of falsification of a card has been formed mainly by employing a technique of foil transferring.

In a transfer foil used for the foil stamping, for example, a protective layer, a transfer material layer and an adhesive layer are provided on a release agent layer formed on a film support made of a resin, in which the transfer material layer is formed by vacuum evaporation or by using an ink. The technique to produce a transfer foil has been improved in accordance with the enlargement of the market of the transfer foil. For example, researches on a transfer foil having a protective layer containing an organic silicon compound and a reactive organic compound in view of improving the durability of a foil image, and on a transfer foil having an electron beam curable adhesive layer by which a stronger protective layer is formed by being irradiated with an electron beam after peeled from the support, have been brought forward (for example, refer to Patent Documents 1 and 2). Since many of these transfer images used for the prevention of falsification or for security of the cards contain a precise pattern, it is required to accurately transfer the image but not to cause a problem such as a burr or missing of the foil. For example, such a requirement has been solved by using a transfer foil incorporating a polymer liquid crystal material in a transfer layer (for example, refer to Patent Documents 3).

On the other hand, in order to conduct foil transfer on a base substance with a simple process, advanced has been a technique to form a resin layer on the surface of a base substance by using toner and to provide a transfer foil on the resin layer. Because synergistic effect can be obtained between an adhesive force fanned by softening or melting of toner and an adhesive force formed by melting of an adhesive layer of a transfer foil via heating, this technology can realize a strong adhesion between a base substance and a foil. Specifically, a convexes image or a design image is formed on a base substance by using toner, followed by heat-pressuring a transfer foil onto the formed toner image, resulting in transferring a foil (for example, refer to Patent Document 4).

Further, there is a technique for transferring a metal foil on a base substance in which a toner is preliminary adhered on a base substance, provided thereon an evaporated foil sheet, hot pressed by an iron, followed by peeling the evaporated foil sheet from the base substance (for example, refer to Patent Document 5). In these foil transfer technique using toner, the foil transfer can be carried out without using a metal pressing member called a press as required in the conventional technique, resulting in reducing necessary time for a foil transfer process or simplifying an apparatus of a foil transfer.

As described above, one of method for forming a foil image on a base substance is to heat and melt a foil transferring face provided by toner and a transfer foil, followed by transferring a foil image on the foil transferring face through adhesion layer.

PRIOR ART DOCUMENTS

Patent Documents

[Patent Document 1] Unexamined Japanese Patent Application Publication (hereinafter referred to as JP-A) No, 9-1995

[Patent Document 2] JP-A No. 2007-15159

[Patent Document 3] JP-A No. 2009-90464

[Patent Document 4] JP-A No. 1-200985

[Patent Document 5] JP-A No. 2000-127691

SUMMARY OF THE INVENTION

Incidentally, in a method for forming a foil image by heating and melting a foil transferring face and a transfer foil, it was found to have tendency to occur fine wrinkles on the formed foil image. Reason for causing these wrinkles were presumed as follows: since amount of heat for heating and melting a foil transferring face was excess in view of heating and melting a adhesive layer on the transfer foil, thereby a strain occurs on the foil and results in causing wrinkles. On the contrary, when a heating temperature was set lower, in order to supply lower amount of heat for preventing excess heat supply to the transfer foil, it caused that the foil transferring face could not be softened sufficiently and could not have an adhesive force to hold the transferred foil image strongly.

Thus, the inventor of the present invention found that since there existed a difference of a heating temperature between for heating and melting a foil transferring face and melting an adhesive layer on the transfer foil in prior art, thereby it was required to match both temperature characteristics so as to form a foil image exhibiting excellent finish without wrinkle and a strong adhesive strength. Further, in view of productivity in manufacturing, it was also required a property of a foil transferring face and a transfer foil to be softened and melted in a short time.

In view of the foregoing, the present invention was achieved. An object of the present invention is to provide an image forming method for forming a foil image exhibiting excellent finish without wrinkle and a strong adhesive strength by heating and melting a foil transferring face and a transfer foil at same level heating temperature.

The inventors of the present invention found that above described problems were resolved by any one of constitutions described below. That is, 1. An image forming method comprising at least steps of (a) forming an electrostatic latent image by exposing a photoreceptor, (b) forming a foil transferring face by supplying a toner onto the photoreceptor having the electrostatic latent image, (c) transferring the foil transferring face formed on the photoreceptor through an intermediate transfer belt or directly to a base substance, (d) fixing the foil transferring face transferred on the base substance, (e) feeding a transfer foil to the base substance having the fixed foil transferring face, and (f) transferring the transfer foil to the foil transferring face by heating the transfer foil while contacting the transfer foil with the foil transferring face, wherein a toner for forming the foil transferring face has a glass transition temperature of not more than 60° C., the transfer foil is transferred to the foil transferring face by heating the transfer foil and the foil transferring face while passing through a nip portion formed between a driving roller and a follower roller in the step of (f), and an outside diameter at a longitudinal end of the driving roller is larger than an outside diameter at other than the longitudinal end of the driving roller.

2. The image forming method of item 1, wherein a difference between the outside diameter at the longitudinal end of the driving roller and a minimum outside diameter in a longitudinal direction of the driving roller is not less than 0.05 mm and not more than 0.40 mm.

3. The image forming method of item 1 or 2, wherein the follower roller has an outside diameter at a longitudinal end being smaller than an outside diameter at other than the longitudinal end or the same outside diameter in a longitudinal direction.

4. The image fanning method of item 3, wherein a difference between the outside diameter at the longitudinal end of the follower roller and a maximum outside diameter in a longitudinal direction of the follower roller is not more than 0.20 mm, when the follower roller has an outside diameter at a longitudinal end being smaller than an outside diameter at other than the longitudinal end 5. The image forming method of any one of items 1-4, wherein the base substance on which the transfer foil and the foil transferring face are fixed passes through a nip portion formed between a driving roller and a follower roller at a speed of not less than 100 mm/second and not more than 400 mm/second.

6. The image forming method of any one of items 1-5, wherein the transfer foil has an adhesion layer having a softening temperature of not less than 75° C. and not more than 105° C.

7. The image forming method of any one of items 1-6, wherein at least one of the driving roller and the follower roller has a heating member.

8. An image forming apparatus comprising at least members of:

a photoreceptor which forms an electrostatic latent image by exposing by an exposing member, a foil transferring face forming member which forms a foil transferring face by supplying a toner onto the photoreceptor having the electrostatic latent image, a foil transferring face transferring member which transfers the foil transferring face formed on the photoreceptor to a base substance, a fixing member which fixes the foil transferring face transferred on the base substance, a transfer foil feeding member which supplies a transfer foil to the base substance having the fixed foil transferring face, and a transfer foil transferring member which transfers the transfer foil on the foil transferring face by heating the transfer foil while contacting the transfer foil to the foil transferring face, wherein a toner supplied by the foil transferring face forming member has a glass transition temperature of not more than 60° C., the transfer foil transferring member has a driving roller having an outside diameter at a longitudinal end larger than an outside diameter at other than the longitudinal end, and a follower roller, and the transfer foil transferring member transfers the transfer foil on the foil transferring face by heating the transfer foil and the foil transferring face while passing through a nip portion formed between a driving roller and a follower roller.

9. The image fanning apparatus of item 8, wherein a difference between the outside diameter at the longitudinal end of the driving roller and a minimum outside diameter in a longitudinal direction of the driving roller is not less than 0.05 mm and not more than 0.40 mm.

10. The image forming apparatus of item 8 or 9, wherein the follower roller has an outside diameter at a longitudinal end being smaller than an outside diameter at other than the longitudinal end or the same outside diameter in a longitudinal direction.

11. The image forming apparatus of item 10, wherein a difference between the outside diameter at the longitudinal end of the follower roller and a maximum outside diameter in a longitudinal direction of the follower roller is not more than 0.20 mm, when the follower roller has an outside diameter at a longitudinal end being smaller than an outside diameter at other than the longitudinal end.

12. The image forming apparatus of any one of items 8-11, wherein the base substance on which the transfer foil and the foil transferring face are fixed passes through a nip portion formed between a driving roller and a follower roller at a speed of not less than 100 mm/second and not more than 400 mm/second.

13. The image forming apparatus of any one of items 8-11, wherein the transfer foil has an adhesion layer having a softening temperature of not less than 75° C. and not more than 105° C.

14. The image forming apparatus of any one of items 8-12, wherein at least one of the driving roller and the follower roller has a heating member.

In the present invention, it enables to form a foil image exhibiting excellent finish without wrinkle and a strong adhesive strength by using a toner for forming the foil transferring face having a glass transition temperature of not more than 60° C., and an outside diameter at a longitudinal end of the driving roller which is used for the transferring a foil onto the foil transferring face is larger than an outside diameter at other than the longitudinal end. That is, above described constitution enables to prevent wrinkle of transfer foil caused by heat, since foil transferring face can be softened and melted by lower amount of heating, resulting in avoiding excess healing on transfer foil. Further, at a nip portion where a foil is transferred onto a foil transferring face, a driving roller functions a force toward outside of width direction to the transfer foil and it prevents the transfer foil from causing wrinkle caused by mechanical stress. As the result, a foil image exhibiting excellent finish without wrinkle and a strong adhesive strength can be formed.

Further, above described constitution enables to shorten a time for transferring foil. As Examples described later, for example, even when a conveying speed at nip portion is not less than 100 mm/second and not more than 400 mm/second, foil image can be stably formed which has strong adhesion onto base substance. Moreover, since required heat amount for forming a foil image can be also reduced, thereby an environment-friendly foil image forming method can be realized.

DETAILED DESCRIPTION OF THE INVENTION

The present invention relates to an image forming method which forms a foil image on a base substance (an image supporting material) by forming a toner image area called a foil transferring face, followed by forming the foil image by transferring a foil on the foil transferring face. In the present invention, above object is achieved by employing a toner for forming the foil transferring face having a glass transition temperature of not more than 60° C., and by employing a driving roller used for transferring a transfer foil onto the foil transferring face which has an outside diameter at a longitudinal end being larger than an outside diameter at other than the longitudinal end.

The inventor of the present invention conducted diligent investigations about wrinkle caused on transfer foil and considered that there are two factors. One is caused by heat for a foil adhering onto a foil transferring face, and another is caused by stress from a driving roller when transfer foil passes through a nip portion. When transfer foil was transferred onto foil transferring face, both of foil transferring face and adhesive layer of transfer foil were softened and melted by heating and the transfer foil adhered to foil transferring face. Thus, foil adhesion was conducted under functioning synergistic effect between both adhesion forces of foil transferring face and adhesive layer of a transfer foil. However, since performances of softening and melting between adhesion force of foil transferring face and adhesive layer of a transfer foil were imbalanced and excess heat was supplied to the transfer foil, thereby wrinkle occurred on the transfer foil. Therefore, the inventor considered to realize softening and melting foil transferring face adequately at the heating temperature for foil transferring face being softened and melted, by lowering a glass transition temperature of toner which forms foil transferring face. After investigation to find out the glass transition temperature of toner which enables to realize above, the inventor found that by employing a toner for forming the foil transferring face having a glass transition temperature of not more than 60° C., foil transferring face can be adequately softened and melted at the same heating temperature for foil transferring face being softened and melted. As described above, wrinkle caused by heating can be prevented.

Figure 1A:
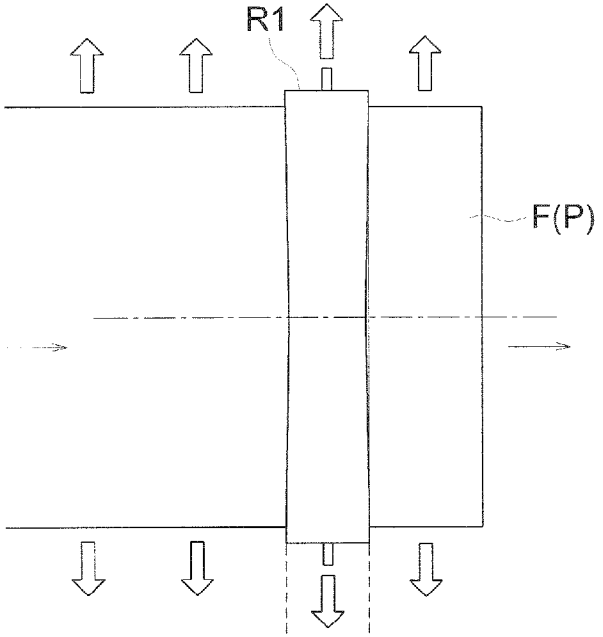
FIG. 1*a*-1*c* each is a schematic diagram showing a conveying condition when a base substance P having a foil transferring face H and a transfer foil F are layered and passed through a nip portion Rn.
Figure 1B:
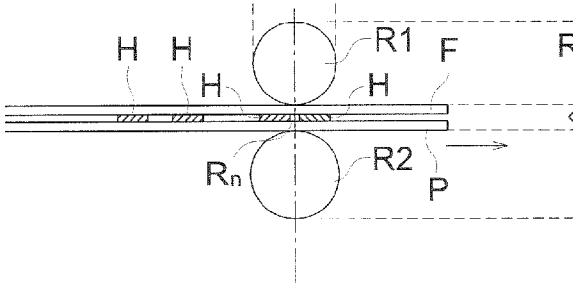
Figure 1C:
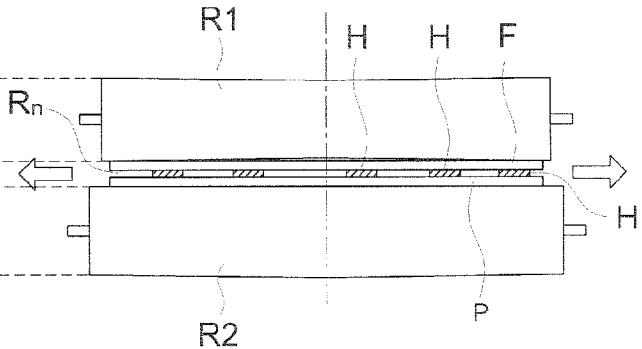

Further, the inventor focused on a force to a transfer foil when passing through nip portion and considered that strain was caused on the transfer foil by forces from various directions when passing through nip portion, thereby caused wrinkle. Therefore, the inventor considered that wrinkle may not occur when conveyance is conducted while a tensile force is applied to a direction as indicated by outline arrow in FIG. 1, that is, a force toward outside of width direction to the transfer foil during passing through nip portion. FIG. 1 is a schematic diagram showing a conveying condition when a base substance P having a foil transferring face H and a transfer foil F are layered and passed through a nip portion Rn. FIG. 1*a* shows a top view of conveying condition of transfer foil F and base substance P. FIG. 1*b* shows a side view. FIG. 1*c* shows a front view. In FIG. 1, R1, R2 and Rn each represents a driving roller, a follower roller and a nip portion, respectively.

The inventor investigated driving roller which can pass transfer foil through nip portion by applying a tensile force to a direction as indicated by outline arrow in FIG. 1. The inventor found that a driving roller having a shape showing in FIG. 2*a* can realize to apply a tensile force which does not affect unnecessary force and has a force toward outside of width direction to the transfer foil. That is, an outside diameter of the driving roller is changed along with a longitudinal direction, and the driving roller has a shape which can strongly press an edge of the transfer foil, thereby only the tensile force to a direction as indicated by outline arrow in FIG. 1 is applied to the transfer foil and t unnecessary force other than these does not affect on the transfer foil. Thus, the inventor considered that a constitution in which transfer foil is pressed at a longitudinal end of the driving roller is the easiest constitution for applying the tensile force toward outside of width direction to the transfer foil as indicated by outline arrow in FIG. 1.

Figure 2A:
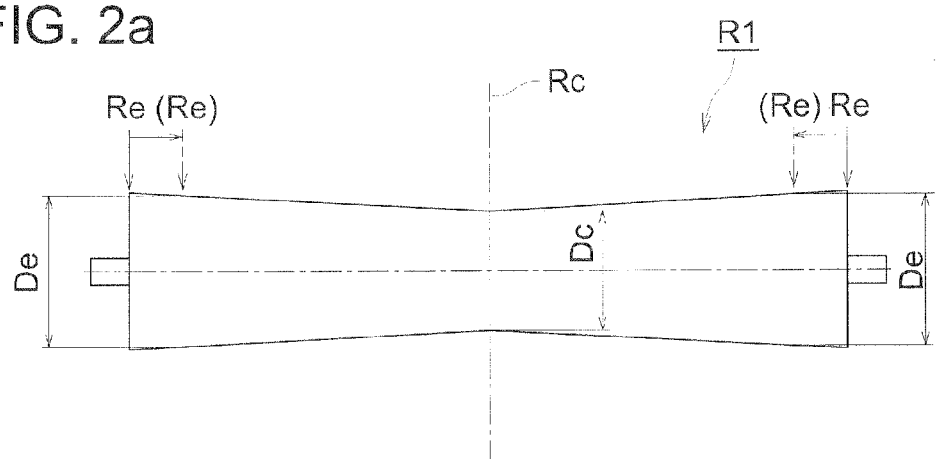
FIG. 2*a*-2*c* each is a schematic diagram showing a shape of a driving roller and a follower roller preferably employed in the present invention.

The inventor found that a driving roller having a shape shown in FIG. 2*a* can possess sufficient conveyance as well as pressing a transfer foil at a longitudinal end of the driving roller during passing through nip portion. Thus, a driving roller having a shape shown in FIG. 2*a* can prevent wrinkle caused by stress from a driving roller.

The present invention will now be detailed.

At first, the terms used in the present invention will be described. "Foil transferring face" refers to an area on an image support or a base substance such as plastic moldings to where a foil is transferred and is formed by employing the toner related to the present invention.

In the present invention, the terms "product" and "base substance" are used. Either of them is constituted of a support called "image support" on which image forming via a well-known image forming method is capable. Here, the "product" as mentioned in the present invention refers to a support decorated with a foil formed by at least transferring a foil on a base substance, and the "base substance" as mentioned in the present invention refers to an image support constituted of a base material such as paper or PET (polyethylene telephthal ate) or a substance having a three-dimensional shape, for example, a plastic molding. Further, in the present invention, a substance, on which the foil transferring face is formed or the foil is transferred but before available to user is also referred to as "base substance".

Furthermore, the "foil" as mentioned in the present invention is also re cued to as "transfer foil", which is used to provide a text image or a picture image having a metallic or glossy appearance which is difficult to be provided via a normal printing. Various kinds of transfer foil can be available having different expressions such as gold-silver foil, color pigmented foil, or hologram foil, however the present invention is not limited thereto. These transfer foils enable to form gold or silver image, color image having metal glossiness or hologram image. Transfer foil has a layer structure, for example shown in FIG. 7. That is, a transfer foil has a constitution comprising a base support, provided thereon a releasing layer, a foil layer and an adhesion layer and is capable of adhering onto a foil transferring face formed by a toner on an image support. Herein, the foil layer comprises a colored layer or a vapor deposited layer. A releasing layer is also referred to as a release layer.

The method for forming the image of the present invention (hereinafter referred to as method for transferring foil) will now be summarized. The method for forming the image of the present invention will be detailed later. The method for transferring foil of the present invention can be attained by undergoing the following processes from (1) to (7):

(1) forming an electrostatic latent image by exposing an electrophotographic photoreceptor, (2) forming a foil transferring face by supplying a foil transferring face forming toner related to the present invention onto the electrophotographic photoreceptor having the electrostatic latent image, (3) transferring the foil transferring face formed on the electrophotographic photoreceptor through an intermediate transfer belt or directly to a base substance, (4) fixing the foil transferring face by heating which is transferred on the base substance, (5) feeding a transfer foil to the base substance having the fixed foil transferring face, (6) transferring the foil onto the foil transferring face by heating the foil transferring face and the transfer foil, and (7) peeling the transfer foil from the base substance.

Thus, in the method of foil transfer of the present invention, at first, a photoreceptor is exposed to form an electrostatic latent image having the shape of the foil transferring face to be formed on the product and the foil transferring face fanning toner of the present invention is supplied to the photoreceptor on which the electrostatic latent image is formed, whereby a foil transferring face is formed. The foil transferring face formed on the photoreceptor is transferred onto abase substance, and a transfer foil is supplied onto the base substance having the foil transferring face which is fixed by heating to be in contact with the base substance. Under this state, the transfer foil and foil transferring face are heated to transfer the foil onto the foil transferring face.

In the present invention, it was found that the effect of the invention is effective by employing a toner having glass transition temperature of not more than 60° C. in above process (2), and employing a driving roller having an outside diameter at a longitudinal end being larger than an outside diameter at other than the longitudinal end.

The foil transferring face forming toner employed in the present invention will now specifically be described. The foil transferring face forming toner of the present invention has a glass transition temperature of not more than 60° C. The glass transition temperature of toner in above range enables the foil transferring face formed by employing the toner to be softened and melted at the same heating temperature as the transferred foil. As described later, in a transfer foil available in the market, so called hot melt type adhesive agent is used which has a softening temperature from 80° C. to 120° C. When a glass transition temperature of toner for forming the foil transferring face is high, heating temperature for softening and melting the foil transferring face becomes high and excess heat is supplied on the transfer foil.

According to the present invention, since a foil transferring face can be softened and melted at the same heating temperature as a transfer foil, thereby excess heat cannot be supplied on the transfer foil such as the case that the foil transferring face is formed by employing the toner having a high glass transition temperature, resulting in preventing wrinkle of the transfer foil which causes by heating. Namely, in the conventional techniques, for example, a heating temperature of 120° C.-155° C. is required for softening and melting a foil transferring face forming toner. It causes excess heating to the transfer foil which can be softened and melted at far lower temperature range, and resulting in causing wrinkle.

The glass transition temperature can be typically measured by using differential scanning colorimeter (DSC). Specific examples of differential scanning colorimeter include DSC-7 differential scanning colorimeter and TAC7/DX thermal analyzer controller (both produced by Perkin Elmer Corp.).

A substantial method of measuring a glass-transition temperature of a test sample contains the steps of keeping the test sample at −30° C. for one minute and heating the sample to 100° C. at a rate of 10° C./minute (the first heating step), keeping the test sample at 100° C. for one minute and cooling the sample down to 0° C. at a rate of 10° C./minute (the first cooling step), to erase the previous record. Then, keeping the test sample at 0° C. for one minute and heating the sample to 100° C. at a rate of 10° C./minute (the second heating step), and getting the endothermic peak temperature in the second heating as the glass-transition temperature (Tg) of the test sample.

The glass-transition temperature (Tg) is defined as an intersection at which the extension of the base line below the glass-transition temperature (Tg) on the DSC thermogram in the glass transition area meets a tangent of the greatest gradient between the rise and the top of the peak.

The measurement of the glass-transition temperature is specifically conducted as follows. A toner of 4.5-5.0 mg is precisely weighed to two places of decimals, sealed into an aluminum pan (KIT No. 0219-0041) and set into a sample holder. An empty aluminum pan is used as a reference. The temperature was controlled through heating-cooling-heating at a temperature-rising rate of 10° C./min and a temperature-lowering rate of 10° C./min in the range of 0 to 200° C. and the glass-transition temperature is analyzed based on a data at $2^{nd}$ Heat.

The glass-transition temperature can be determined by using an atomic force microscope. Namely, heating a stage of an atomic force microscope at 0-80° C., the glass-transition temperature is defined as a temperature where a hardness of a section of toner or block changes.

In the toner of the present invention, as a method for controlling a glass transition temperature in the range of not more than 60° C., listed is a method for controlling factors such as resin composition or molecular weight of the toner, for example. One of the specific methods for controlling the resin composition includes a method for controlling a glass transition temperature by changing a ratio of a monomer which tends to decrease a glass transition temperature among the monomers constituting vinyl based copolymer.

Specific examples of polimerizable monomer having tendency to decrease a glass transition temperature include propyl acrylate, propyl methacrylate, butyl acrylate, butyl methacrylate, 2-ethylhexyl acrylate and 2-ethylhexyl methacrylate. A glass transition temperature of a resin can be decreased by increasing a content of these polymerizable monomers.

Driving roller and follower roller used in above described process (6) will be now detailed. As shown in FIG. 1, process (6) is conducted by conveying a base substance P formed a foil transferring face H and a transfer foil F in a layered state and passing through a nip portion Rn formed by driving roller R1 and follower roller R2. Namely, when passing through a nip portion Rn formed by driving roller R1 and follower roller R2, a base substance P formed a foil transferring face H and a transfer foil F are heated, thereby the foil having softened and melted adhesion layer is transferred to the softened and melted foil transferring face.

Driving roller employed in the present invention will be detailed. In the present invention, driving roller constituting a heating-transferring member has an outside diameter at a longitudinal end being larger than an outside diameter at other than the longitudinal end, such as a shape shown in FIG. 2*a*.

Driving roller R1 shown in FIG. 2*a* has outside diameter De at longitudinal end Re being larger than outside diameter D at other than the longitudinal end and generally called as "inverted crown" shape. When a driving roller R1 has "inverted crown" shape, a driving roller R1 presses a transfer foil F at two ends Re and a tensile force indicated by outline arrow in FIG. 1, that is, a force toward outside of width direction to the transfer foil F prevents the transfer foil F from causing wrinkle.

Herein, "end" referred to as a portion Re shown in FIG. 2*a* and an outside diameter De at the portion shown by Re is larger than an outside diameter D at other than the portion of Re. "End" is not limited at the portion where forms actual end and the portion of arbitrary length to the center from the end is also referred to as "end". For example, in ease of measuring an outside diameter at the end of a driving roller having 360 mm length, the portion of 30 mm inside from the actual end may be referred as "end" and the outside diameter at this portion may be referred to as the outside diameter of the end of the roller.

Driving roller shown in FIG. 2*a* has an inverted crown shape formed in accordance with straight line from the longitudinal center Rc. However, driving roller may have an inverted crown shape formed in accordance with arc-like or hyperbolic curve or combination of straight line and curved line.

"Crown amount" is employed as one of the methods for quantifying a shape of roller which has different outside diameter at portions in longitudinal direction as shown in roller in FIG. 2*a* which is defined by the difference between maximum outside diameter and minimum outside diameter. As driving roller shown in FIG. 2*a* has maximum outside diameter at end portion Re and minimum outside diameter at center of roller Re, crown amount can be calculated by (Outside diameter De at center of roller Re)−(Outside diameter De at end of roller Re). Herein, in the case of roller having "inverted crown" shape, crown amount may be called as "inverted crown amount" with negative sign (−) to the crown amount value, and in the case of roller having "crown" shape, crown amount may be called as "positive crown amount" with positive sign (+) to the crown amount value.

In the present invention, crown amount of driving roller, namely, a difference between outside diameter at longitudinal end of the driver roll and a minimum outside diameter in a longitudinal direction is not specifically limited, however, is preferable not less than 0.05 mm and not more than 0.4 mm. When crown amount is within the range described above, surface of roller forms a shallow slope from the end portion to the center portion and this shallow slope enable to pull the transfer foil with adequate force at the end portion of driving roller. As the result, an adequate tensile force is applied on the transfer foil to a direction as indicated by outline arrow in FIG. 1, resulting in stable conveyance. Further, driving roller can convey a rotary movement effectively to transfer foil and base substance by rotating driving roller, it is preferable to convey stably and steadily. Further, rotative force of the driving roller is transferred effectively and steadily to follower roller and can contribute to a conveyance of base substance which is mostly depended on the rotation of follower roller.

Next, a follower roller will be detailed which form nip portion together with the driving roller described above. A follower roller conveys a transfer foil and a basic substance having a foil transferring face together with a driving roller at nip portion. In the present invention, shape of a follower roller is not specifically limited, however, preferable is a shape which can apply adequate pressure contact to transfer foil or a basic substance, in view of applying efficient conveyance to a transfer foil and a basic substance.

Figure 2B:
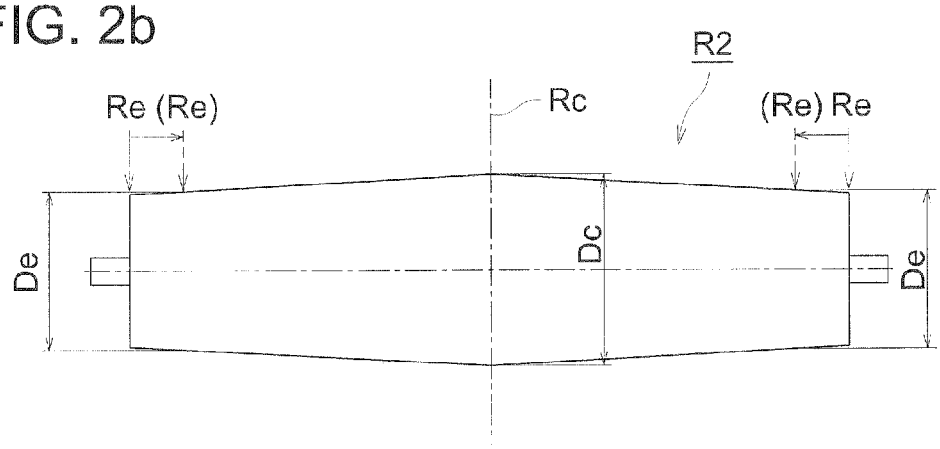
Figure 2C:
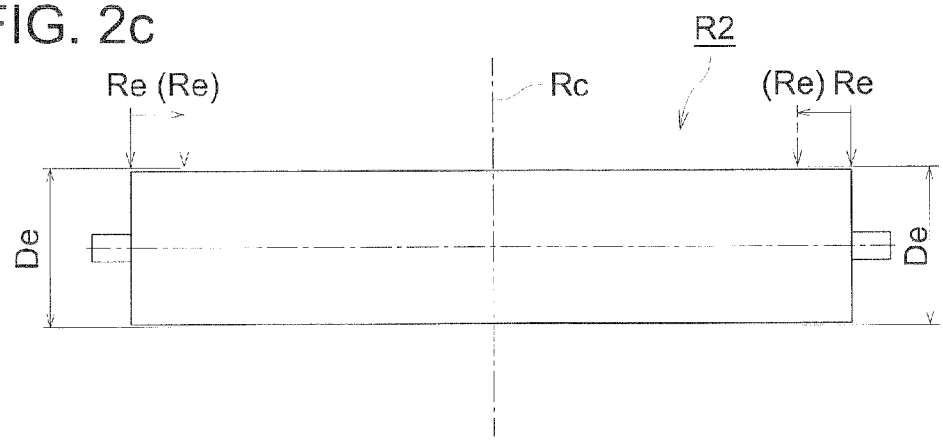

From above point of view, a preferable shape of a follower roller is either one which has smaller outside diameter at a longitudinal end than an outside diameter at other portion than longitudinal end as shown in FIG. 2*b*, or which has equal outside diameter through longitudinal direction as shown in FIG. 2*c*. Follower roller R2 shown in FIG. 2*b* has smaller outside diameter at a longitudinal end than an outside diameter at other portion than longitudinal end. That is, an outside diameter at a longitudinal end is smaller than an outside diameter at other portion than longitudinal end, namely it has positive crown shape. Follower roller R2 shown in FIG. 2*c* has straight shape having equal and uniform outside diameter.

When a follower roller has positive crown shape in which an outside diameter at a longitudinal end is smaller than an outside diameter at other portion than longitudinal end as shown in FIG. 2*b*, amount of crown is not specifically limited, unless it impairs a contact to an transfer foil at the end of the driving roller described above. Namely, when a follower roller presses a basic substance at the maximum diameter of the follower roller and contacts to a transfer foil at other portion than an edge of driving roller, a force other than a direction as indicated by outline arrow in FIG. 1 is applied to a transfer foil, and it causes wrinkle to the transfer foil. Therefore, the follower roller which causes these phenomena is unable to employ. In the present invention, in case of employing a follower roller having shape of FIG. 2*b*, a difference between the outside diameter at the longitudinal end of the follower roller and a maximum outside diameter in a longitudinal direction is preferable not more than 0.20 mm.

The method for forming the image of the present invention (hereinafter referred to as method for transferring foil) will now be detailed. The method for transferring foil of the present invention can be attained by undergoing the following processes from (1) to (7):

(1) forming an electrostatic latent image by exposing a photoreceptor, (2) forming a foil transferring face by supplying a foil transferring face forming toner related to the present invention onto the photoreceptor having the electrostatic latent image, (3) transferring the foil transferring face formed on the photoreceptor through an intermediate transfer belt or directly to a base substance, (4) fixing the foil transferring face by heating which is transferred on the base substance, (5) feeding a transfer foil to the base substance having the fixed foil transferring face, (6) heating the transfer foil, and (7) peeling the transfer foil from the base substance while leaving a portion of the transfer foil adhered on the foil transferring face.

Thus, in the method of foil transfer described above, at first, a photoreceptor is exposed to form an electrostatic latent image having the shape of the foil transferring face to be formed on the product and the foil transferring face forming toner is supplied to the photoreceptor on which the electrostatic latent image is formed, whereby a foil transferring face is formed. The foil transferring face formed on the photoreceptor is transferred onto a base substance, and a transfer foil is supplied onto the base substance having the foil transferring face which is fixed by heating to be in contact with the base substance. Under this state, the transfer foil and foil transferring face are heated to transfer the foil onto the foil transferring face.

The method for transferring foil will now specifically be described with reference to accompanying FIG. 3. FIG. 3 is a schematic diagram which shows a procedure reflecting steps of (4) to (7) among above steps (1) to (7). Through steps (1) to (3) (not illustrated in FIG. 3), a foil transferring face H is formed on a base substance P, a transfer foil F is supplied onto the base substance P, the supplied transfer foil F is contacted to the foil transferring face H and heated, and a foil f2 is transferred on the foil transferring face H. FIG. 3*a* to FIG. 3*d* will now specifically be described.

Figure 3A:
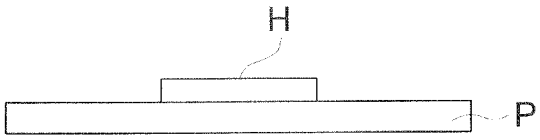
FIG. 3*a*-3*e* each is a schematic diagram showing a procedure for transferring a foil onto a foil transferring face formed on a base substrate.

FIG. 3*a* is a cross-sectional view of a base substance P formed thereon the foil transferring face by using the toner related to the present invention on a sheet base substance P. A method for forming the foil transferring face H on the base substance P through steps (1) to (3) will be described later with reference to FIG. 4.

Figure 3B:
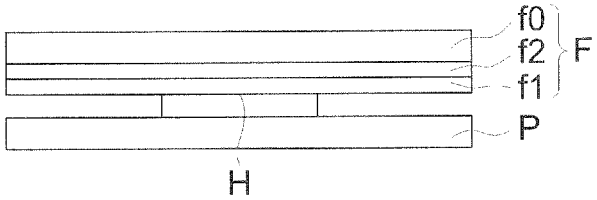

FIG. 3*b* illustrates a state in which a transfer foil F is supplied onto a base substance P. Transfer foil F is supplied so as to form contact with foil transferring face H. Supplied transfer foil F is supposed to be contacted with all over the base substance P. Therefore, at least the transfer foil F forms in contact with the foil transferring face H convexly formed on the base substance. The transfer foil F of the present invention has at least a foil layer f2 on a base film f0, and may have an adhesive layer f1 for enhancing an adhesive property with the foil transferring face H. The transfer foil F applicable to the present invention will be detailed later.

Figure 3C:
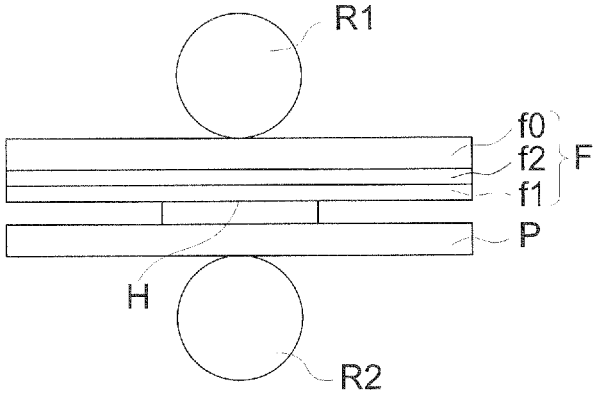

FIG. 3*c* illustrates a state in which a base substance P is passed between a driving roller R1 and a follower roller R2 while the transfer foil F is in contact with the base substance P. Herein, a driving roller R1 and a follower roller R2 also functions as heating and pressuring roller. During the base substance P is passed between a driving roller R1 and a follower roller R2 (nip portion), foil transfer face H and the adhesive layer f1 of the transfer foil F is softened and melted by heating, whereby the transfer foil is melt contacted onto the foil transferring face H.

Then, after passing through between nip portion of a driving roller R1 and a follower roller R2, the foil transferring face H and the adhesive layer f1 is cooled and hardened in a state of the transfer foil F melt contacted with the foil transferring face H, whereby the transfer foil F forms strong adhesive state with the foil transferring face H. Thus, the transfer foil F forms adhesive state between an area of being contacted with the foil transferring face H on the base substance P and the foil transferring face H, whereby transferred is a foil which has a shape coincident to the shape of the foil transferring face H.

Figure 3D:
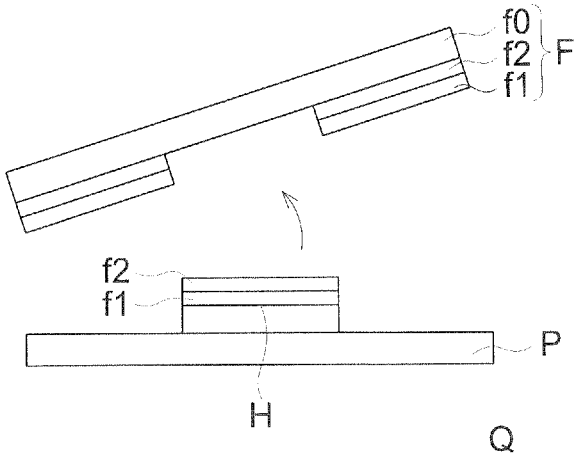

FIG. 3*d* illustrates a state in which the transfer foil F is peeled off from the base substance P which adheres to the transfer foil F through the foil transferring face H. After peeling off the transfer foil F, a foil layer f2 is transferred on the foil transferring face H of the base substance P through the adhesive layer f1. According to the present invention, the foil layer f2 is transferred correspondingly to the shape of the foil transferring face by using a toner for forming the foil transferring face, whereby the foil layer f2 having the predetermined shape enables to be transferred without using a metal press.

Thus, the foil transferred onto the base substance P is conducted by softening and melting the foil transferring face H and the adhesive layer f1 of the transfer foil F to adhere during the base substance P being passed through nip portion formed between a driving roller R1 and a follower roller R2. After passing through nip portion, the foil transferring face H and the adhesive layer f1 of the transfer foil F is cooled to be solid and forms adhesive state between the transfer foil F and the base substance P. Further, by peeling off the transfer foil F, foil layer f2 is transferred onto the foil transferring face H.

Figure 3E:
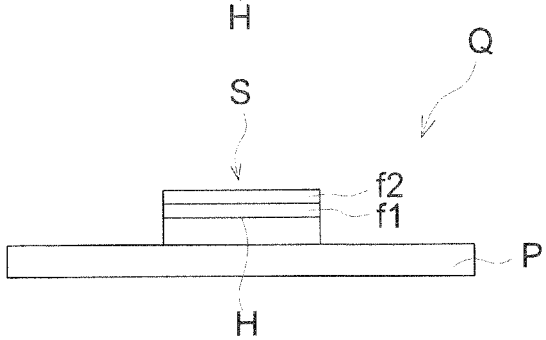

Through above procedure, as shown in FIG. 3*e*, the foil layer f2 is transferred onto the base substance (image support) P through the foil transferring face H formed by foil transferring face forming toner, whereby foil image S is formed. According to the present invention, even when heat treatment is carried out so as to form further toner image on the base substance P having foil image S, the foil transferring face H does not causes any deformation, whereby the foil image does not cause bad quality such as wrinkle or falling off of the foil. Accordingly, it also contributes to improve the aesthetic appearance of the product Q having the foil image S on the base substance P to apply the foil image having excellent resistance on the base substance P.

Next, an example of the foil transferring face formation devices which enables to form a foil transferring face on a base substance employing the foil transfer method of the present invention will be described. The foil transferring face formation device 2 in FIG. 4 enables to perform the steps (1) to (3) among steps (1) to (7), and it has a photoreceptor 11H which forms an electrostatic latent image by light exposure. The foil transferring face formation device 2 has the foil transferring face forming toner feeder 21H which forms the foil transferring face H corresponding to the electrostatic latent image by supplying the foil transferring face forming toner to the photoreceptor 11H. Further, it has a transfer roller 13H which transfers the formed foil transferring face H onto the base substance P from the photoreceptor 11H.

Figure 4:
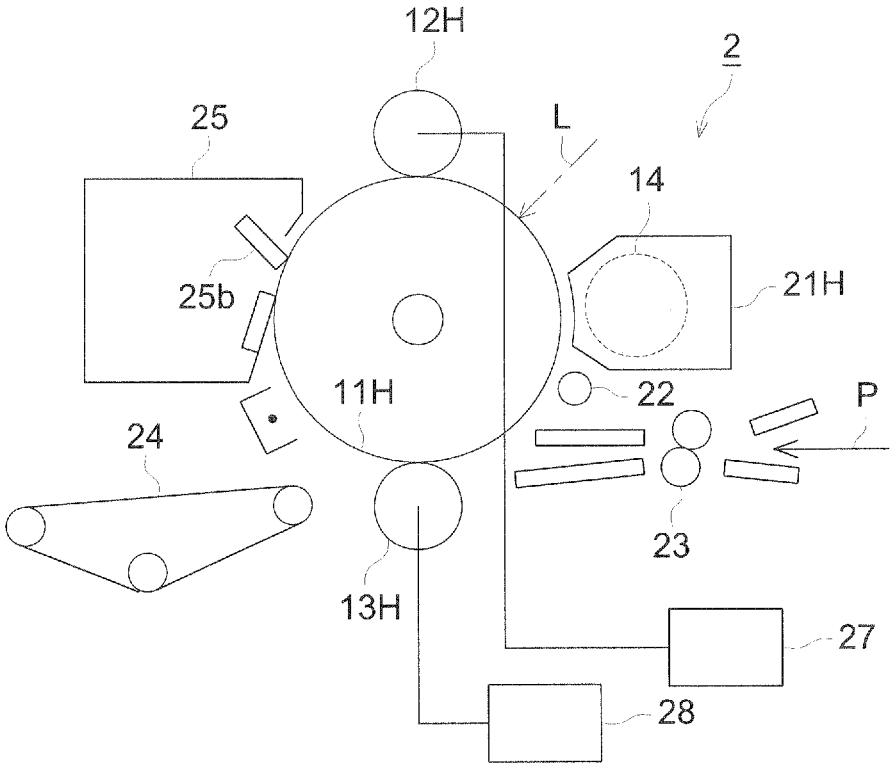
FIG. 4 is a schematic diagram showing a foil transferring face formation device which forms a foil transferring face by an electrostatic latent image method.

Foil transferring face forming device 2 shown in FIG. 4 constitutes a part of an image forming apparatus defined in the present invention which comprises at least members of:

a photoreceptor which forms an electrostatic latent image by exposing by an exposing member, a foil transferring face forming member which forms a foil transferring face by supplying a toner onto the photoreceptor having the electrostatic latent image, a foil transferring face transferring member which transfers the foil transferring face formed on the photoreceptor through an intermediate transfer belt or directly to a base substance, a fixing member which fixes the foil transferring face transferred on the base substance, a transfer foil feeding member which supplies a transfer foil to the base substance having the fixed foil transferring face, and a transfer foil transferring member which transfers the transfer foil on the foil transferring face by heating the transfer foil while contacting the transfer foil to the foil transferring face.

In the foil transferring face formation device 2 of FIG. 4, an electrostatic latent image is formed on the photoreceptor 11H charged with the charging roller 12H in the figure, when the photoreceptor is irradiated with the exposing light L. From the toner feeder 21H of a foil transferring face forming toner provided in the vicinity of the photoreceptor 11H, a foil transferring face forming toner is supplied to the electrostatic latent image formed on the photoreceptor 11H to form a foil transferring face. At this time, the toner feed roller 14 built in the toner feeder 21H of a foil transferring face forming toner is rotated to supply the toner attached on the toner feed roller 14 to the photoreceptor 11H, whereby a foil transferring face is formed on the photoreceptor 11H.

Next, when the electric charge on photoreceptor 11H is neutralized with the neutralizing lamp 22, the foil transferring face on the photoreceptor 11H is transferred onto the base substance P in the transfer section where the photoreceptor 11H and the transfer roller 13H are placed close to each other. The base substance P which is a sheet like material, typically a transfer paper, shown in FIG. 4 is conveyed from the paper cassette which is not illustrated to the transfer section by the conveying roller 23, where an electric charge of the reverse polarity with the polarity of the foil transferring face forming toner is given to the base substance P by the transfer roller 13H. The foil transferring face is transferred onto the base substance P from the photoreceptor 11H according to an electrostatic action of the electric charge of the reverse polarity given by the transfer roller 13H.

After separated from the photoreceptor 11H, the base substance P on which the foil transferring face is transferred is conveyed to the fixing device which is not illustrated by the conveyance belt 24. The fixing device has a fixing means, for example, a heating roller and a pressuring roller, and melts the foil transferring face formed on the base substance P to fix the foil transferring face.

According to the aforementioned procedure, in the foil transferring face formation device 2 shown in FIG. 4, an electrostatic latent image corresponding to the shape of the foil is formed on the photoreceptor 11H, a foil transferring face forming toner is supplied on the photoreceptor 11H to form a foil transferring face, and the foil transferring face formed on the photoreceptor 11H is transferred onto the base substance P with the transfer roller 13H.

Figure 5:
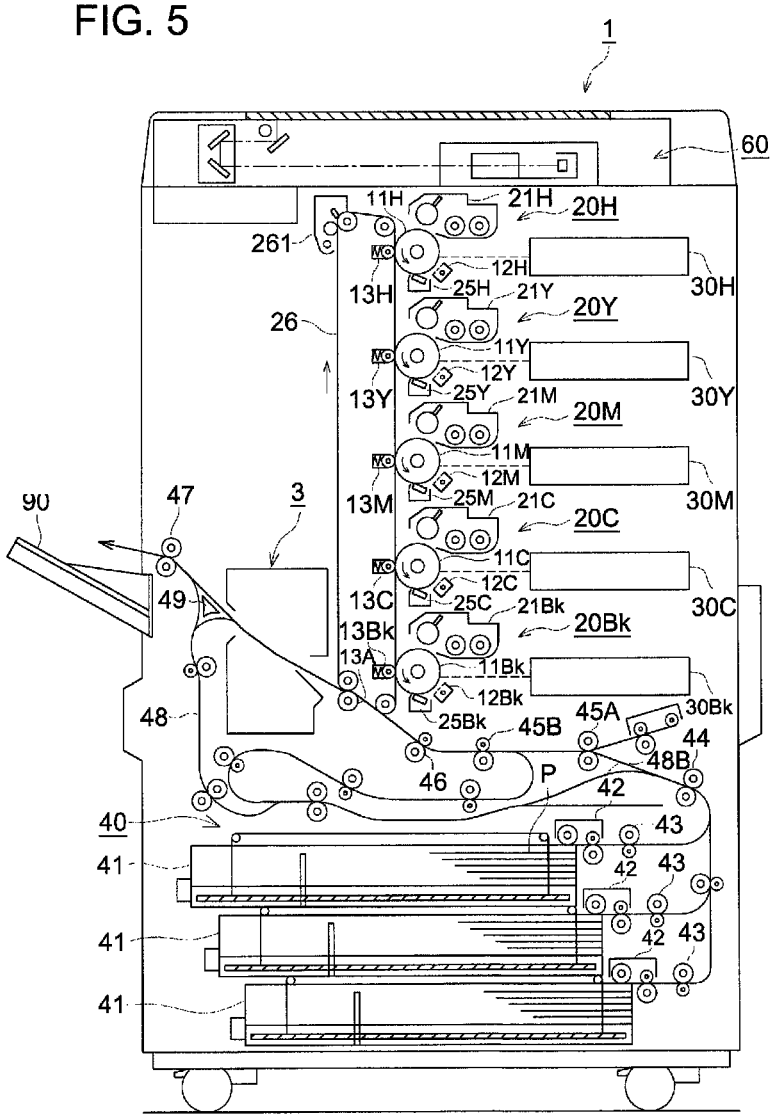
FIG. 5 is a cross-sectional construction view of an image forming apparatus which can form a full color toner image and a foil image on a base substance.

The charging roller 12H shown in the figure may charge the photoreceptor 11H according to the following procedure, for example. Namely, the charging roller 12H is applied with a bias voltage which is composed of a direct-current (DC) component and an alternating current (AC) component from the power supply 27 to charge the photoreceptor drum 11H. The charging method used for the charging roller 12H shown in FIG. 4 is called a contact charging method, and, in the present invention, a non-contact charging method used in the device which will be explained later in FIG. 5 is also applicable to charge the photoreceptor besides the charging system shown in FIG. 4. The bias voltage impressed to the charging roller 12H is a superimposed voltage of, for example, a DC bias of ±500-1000V which is a direct current component, and an AC bias of 100 Hz-10 kHz and 200-3500V which is an alternating current component.

The transfer roller 13H in FIG. 4 is also impressed with a bias voltage containing both a direct current (DC) component and an alternating current (AC) component, as well as the charging roller 12H, to transfer the foil transferring face formed on the photoreceptor 11H onto the base substance P. A specific example of a bias voltage impressed to the transfer roller 13H includes a superimposed voltage of a DC bias of ±500-1000V which is a direct current component, and an AC bias of 100 Hz-10 kHz and 200-3500V which is an alternating current component, similarly to the specific example of a bias voltage impressed to the charging roller 12H.

The charging roller 12H and the transfer roller 13H may be driven by the photoreceptor 11H while being pressed onto the photoreceptor or may be driven by themselves. The pressing force of these rollers to the photoreceptor drum 11H is, for example, $9.8\times10^{-2}$-$9.8\times10^{-1}$N/cm and a rotation speed of the rollers are, for example, as 1 to 8 times as peripheral speed of the photoreceptor 11. The above pressing force of the rollers onto the photoreceptor 11H can be obtained, for example, by applying a force of 1 N-10 N to both ends of the charging roller 12H.

In addition, the residual toner on the photoreceptor 11H after transferring the foil transferring face to the base substance P is removed by the cleaning blade 25*b* provided in the cleaning device 25 to be ready for performing the next foil transferring face formation.

Further, in the present invention, after transferring a foil onto the foil transferring face on the base substance, it is also possible to form a visible image on the base substance by using toners. For example, a foil transferring face is formed on a base substance and a foil is transferred on the foil transferring face, followed by forming a toner image around the transferred foil via an electrophotographic method. Or, it is also possible to form an image having a different type of hue by providing a color toner on the foil. According to these methods, a further luminosity expression can be given to a product having a transferred foil.

FIG. 5 is a cross-sectional configuration diagram of an image forming apparatus which is capable of forming a foil transferring face, transferring a foil onto the formed foil transferring face, and forming a full color toner image. Formation of the foil transferring face onto the base substance via an image forming apparatus shown in FIG. 5 is carried out as the similar procedure as a foil transferring face formation device 2 shown in FIG. 4. The image forming apparatus 1 shown in FIG. 5 has a fixing device 50 in a foil image forming unit 3 as shown in FIG. 6 by which the foil transferring face H formed by employing foil transferring face forming toner is heated and pressed to be fixed on the base substance.

The image forming apparatus 1 shown in FIG. 5 has a structure similar to that of an electrophotographic image forming apparatus so called as a "tandem type color image forming apparatus" and contains a foil transferring face forming unit 20H, a plurality of toner image forming units 20Y, 20M, 20C and 20Bk, a belt-like intermediate transfer belt 26, a sheet feeder 40 and a foil image forming unit 3 which is provided downstream of the intermediate transfer belt 26.

Image forming apparatus 1 shown in FIG. 5 represents an image forming apparatus of the present invention which comprises at least members of a photoreceptor which forms an electrostatic latent image by exposing by an exposing member, a foil transferring face forming member which forms a foil transferring face by supplying a toner onto the photoreceptor having the electrostatic latent image, a foil transferring face transferring member which transfers the foil transferring face formed on the photoreceptor through an intermediate transfer belt or directly to a base substance, a fixing member which fixes the foil transferring face transferred on the base substance, a transfer foil feeding member which supplies a transfer foil to the base substance having the fixed foil transferring face, and a transfer foil transferring member which transfers the transfer foil on the foil transferring face by heating the transfer foil while contacting the transfer foil to the foil transferring face.

Figure 6:
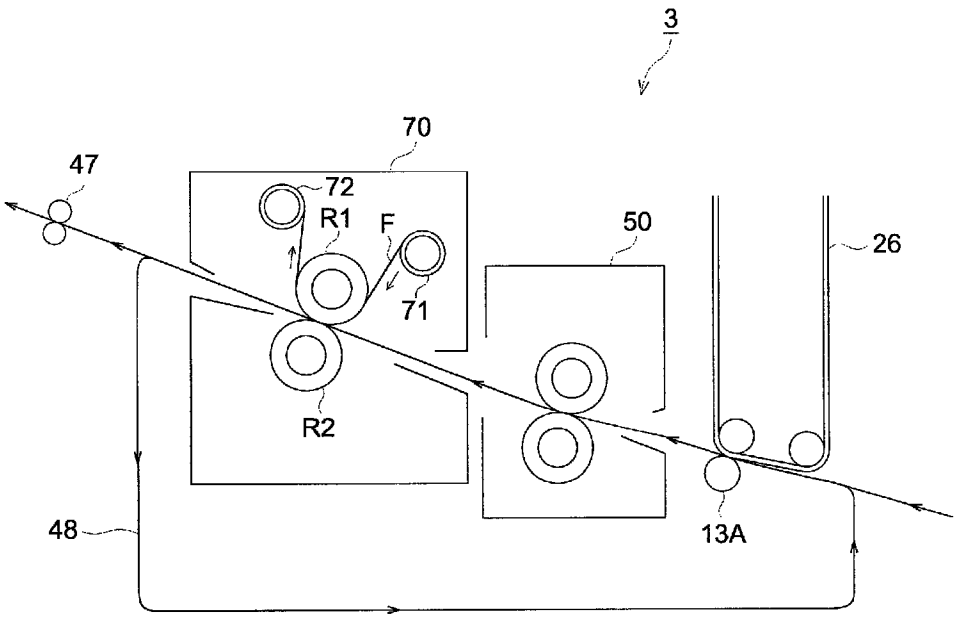
FIG. 6 is a schematic diagram which shows an arrangement of an intermediate transfer belt, a fixation unit and a transfer foil supply unit.

In the image forming apparatus 1 of FIG. 5, at first the toner layer which is formed on a photoreceptor 11H in a foil transferring face forming section 20H is transferred onto a base substance P, followed by fixing the toner layer by fixing device 50 in a foil image forming unit 3 as shown in FIG. 6 to form a foil transferring face H. Then, a transfer foil is supplied onto a base substance P having the foil transferring face H, and the foil is transferred onto the foil transferring face H by passing through a transfer foil feed unit 70 in a foil image forming unit 3 as shown in FIG. 6. Further, a full color image can be formed using a color toner on the base substance P on which a foil has been transferred and the base substance P having full color image is fixed by fixing device 50. In these processes, the image forming apparatus 1 of FIG. 5 enable to form a product Q which has a foil image and toner image on the base substance P. Namely, the image forming apparatus 1 of FIG. 5 enable to form the image through "a step of heating a base substance on which foil transferring face foil is transferred" in the present invention.

The intermediate transfer belt 26, the fixing device 50, and the transfer foil feed unit 70 may be arranged in a configuration shown in FIG. 6. In the foil image forming unit 3 shown in FIG. 6, the intermediate transfer belt 26, the fixing device 50, and the transfer foil feed unit 70 are sequentially arranged. The arrow head in this figure represents the conveying direction of the base substance P. The transfer foil feed unit 70 shown in FIG. 6 has a transfer foil supply roll 71, a driving roller R1, a follower roller R2 and a transfer foil winding roller 72, in which a transfer foil F is provided from the transfer foil supply roll 71, and the spent transfer foil F after foil transfer is rolled up by the transfer foil winding roller 72. In FIG. 6, the foil transferring face formation unit 20H, the toner image formation units 20Y, 20M, 20C and 20Bk are omitted. FIG. 6 will be described in detail later.

Further, the image forming apparatus 1 of FIG. 5 will be detailed. An image reading device 60 is installed in the upper part of the image forming apparatus 1. A manuscript placed on a manuscript holder is image-scanning-exposed to light emitted by an optical system of a manuscript image-scanning exposure device in the image reading device 60 to read the image in a line image sensor. The analog signals photoelectrically converted by the line image sensor are input to light exposure devices 30H, 30Y, 30M, 30C and 30Bk, after conducting analog processing, A/D conversion, a shading correction and image compression processing in control section.

In FIG. 5, in naming a component generically, the reference numerals in which alphabet subscript is omitted are used, and in pointing out discrete components, the reference numerals which is attached with the subscript of H (for foil transferring face), Y (yellow), M (magenta), C (cyan), and Bk (black) are used.

The foil transferring face forming unit 20H which supplies the foil transferring face forming toner, the yellow image forming unit 20Y which performs toner image formation of yellow color, the magenta image forming unit 20M which performs toner image formation of magenta color, the cyan image forming unit 20C which performs toner image formation of cyan color, black image forming unit 20Bk which performs toner image formation of black color each respectively have the following constitution. Namely, (1) drum-lice photoreceptor 11(11H, 11Y, 11M, 11C, 11Bk)

(2) charging electrode 12 (12H, 12Y, 12M, 12C, 12Bk)

(3) light exposure unit 30 (30H, 30Y, 30M, 30C, 30Bk)

(4) foil transferring face forming toner feeder 21H, and developing unit 21 (21Y, 21M, 21C, 21Bk)

(5) cleaning unit 25 (25H, 25Y, 25M, 25C, 25Bk).

The photoreceptor 11 contains an organic photoreceptor in which a photoreceptor layer containing a resin in which an organic photoconductor is incorporated is formed on a peripheral surface of a drum shaped metal support, which is placed extending toward the width direction of the base substance P constituting the product Q (a direction perpendicular to the paper sheet in FIG. 5). As a resin for the photoreceptor layer formation, a well-known resin for forming a photoreceptor layer such as polycarbonate is used. In the embodiment shown in FIG. 5, an example in which a drum shaped photoreceptor 11 is used, however, the photoreceptor is not limited thereto and a belt shaped photoreceptor may be used.

The foil transferring face forming toner feeder 21H includes a two-component developer comprising the foil transferring face forming toner (T) of the present invention and carrier. Further, the developing units 21 each include respective two-component developer comprising a carrier and, respectively, a yellow toner (Y), a magenta toner (M), a cyan toner (C) and a black toner (Bk). The two-component foil transferring face forming developer is constituted of a carrier having ferrite particles on which an insulating resin is coated and the foil transferring face forming toner of the present invention. The two-component developers each are constituted of for example, a carrier having ferrite particles as core on which an insulating resin is coated, a well-known binder resin, a colorant such as a well-known pigment or carbon black, a charge control agent, silica, or titanium oxide.

As for a carrier, the average particle diameter is 10-50 μm and the saturation magnetization is 10-80 emu/g. The average particle diameter of the toner is 4-10 μm. The electrification characteristic of the toner used in the image forming device shown in FIG. 5 is preferably a negative electrification characteristic and the amount of average electric charge is preferably −20 to −60 μC/g. The mixing ratio of the toner and the carrier in each of the two-component foil transferring face forming developer and two-component developers is adjusted so that the content of the toner is 4-10% by mass.

The intermediate transfer belt 26 which is an intermediate transfer medium is rotatably supported by plural rollers. The intermediate transfer belt 26 is an endless belt exhibiting a volume resistance of preferably $10^6$-$10^{12}$Ω·cm. The intermediate transfer belt 26 may be formed with a well-known resin, for example, polycarbonate (PC), polyimide (PI), polyamideimide (PAI), polyvinylideine fluoride (PVDF), or a tetrafluoroethylene-ethylene copolymer (ETFE). The thickness of the intermediate transfer belt 26 is preferably 50-200 μm.

The foil transferring face H formed on the photoreceptor 11H with the toner supplied from foil transferring face forming toner feeder 21H is transferred onto the rotating intermediate transfer belt 26 with the primary transfer roller 13H (primary transfer). The foil transferring face H transferred onto the intermediate transfer belt 26 is then transferred onto a base substance P which is supplied by the sheet feeder 40 which will be described later. The base substance P on which the foil transferring face H is transferred is passed through a fixing device 50 which will be described later to fix the foil transferring face H.

The base substance P of which the foil transferring face H has been fixed is once conveyed through a discharge path having an eject roller 47, and then, through a conveyance path 48, a transfer foil is supplied from the transfer foil feed unit 70. Further, the base substance P supplied with the transfer foil is passed through the transfer foil feed unit 70, while the transfer foil being supplied, to transfer a foil onto the foil transferring face H by heating and pressuring by the driving roller R1 and the follower roller R2 in the transfer foil feed unit 70. As described above, in the image forming apparatus 1 shown in FIG. 5, the base substance P on which the foil transfer face H was fixed is passed through the transfer foil feed unit 70 to form a foil image S. Even when already fixed foil transferring face H is heated again, the foil transferring face H is not influenced to deform by heating, whereby the foil image S having predetermined shape can be formed on the base substance, such that precise linear foil image can be formed as described later in Examples.

The base substance P on which formation of the foil transferring face H and the transfer of the foil were thus performed is conveyed in front of the intermediate transfer roller 26 via the above-mentioned conveyance path 48 to conveyance path for forming toner image 48B, and then, a toner image is formed. First, each color image formed on each of the photoreceptors 11Y, 11M, 11C, 11Bk, respectively, using each color toner supplied by each of toner supplier units 21Y, 21M, 21C and 21Bk, respectively, is sequentially transferred onto intermediate transfer belt 26 employing each of primary transfer rollers 13Y, 13M, 13C, and 13Bk, respectively, whereby a combined full color image is formed. On the other hand, residual toners on the photoreceptor 11H from which the foil transferring face H was transferred and photoreceptors 11Y, 11M, 11C and 11Bk from which toner images were transferred are removed using cleaning units 25 (25H, 25Y, 25M, 25C and 25Bk), respectively.

The base substance P on which formed are foil image S and color image stored in storing member 41 (tray) in sheet feeder 40. The base substance P is fed to first feeding member 42 and conveyed through feeding rollers 43, 44, 45A, 45B, and resist roller 46 (second feeding member) to secondary transfer roller 13A, where the foil transferring face H and the color image is transferred onto the base substance P (secondary transfer).

The three vertically arrayed storing members 41 in the lower portion of the image forming apparatus 1 were provided with the same number since these three members have almost the same structure. Also, the three vertically arrayed feeding members 42 were provided with the same number since the structures are almost the same. The storing members 41 and the feeding members 42 in all are named as a sheet feeder 40.

The foil transferring face H and the full color image transferred onto the base substance P are fixed on the base substance P by fixing unit 50 which melts and cures the foil transferring face H and the full color image by heating and pressuring. The base substance P is conveyed between a pair of conveying rollers 57, discharged through discharge rollers 47, and placed on a discharge tray 90 which is outside of the image forming apparatus.

After transferring the foil transferring face H and the full color toner image onto the base substance P using the secondary transfer roller 13A, the base substance P is separated by curvature separation. The residual toner on the intermediate transfer belt 26 is removed by a cleaning member 261 for the intermediate transfer belt.

When a product Q is prepared in which the foil transferring face H and the full color toner image are formed on both surfaces of the base substance P, a foil transferring face and a full color image are formed on the first surface of the base substance P, followed by melting them to harden, and the base substance P is bifurcated from the discharge path with the bifurcation plate 49. The base substance P is then introduced to a conveyance path 48 to convert the front side and the rear side, followed by conveying again to the feeding roller 45B. Also on the second surface, a foil transferring face H and a full color image are formed by using the foil transferring face forming unit 20H and the image forming unit of each color 20Y, 20M, 20C and 20Bk, followed by being subjected to a heating/pressuring treatment using the fixing unit 50, and discharging out of the image forming device using the discharging rollers 47. Thus, a full color toner image provided with a foil transferring face is formed on both surfaces of the base substance P.

In a foil image forming unit 3 in which an intermediate transfer belt 26, a fixing devise 50 and a transfer foil feed unit 70 are arranged as shown in FIG. 6, formation of a foil transferring face H, transfer of a foil and formation of a toner image are conducted, for example, according to the following procedure. Namely, (1) transferring the foil transferring face H formed on the intermediate transfer belt 26 onto a base substance P at the secondary transfer roller 13A, (2) fixing the foil transferring face H by passing the base substance P through the fixing device 50, (3) feeding a transfer foil F on the base substance P by the driving roller R1 and the follower roller R2 composing the transfer foil feed unit 70, followed by heating and transferring the foil onto the foil transferring face H to form the foil image S, (4) conveying the base substance P formed with the foil image S through the conveyance path 48 to the intermediate transfer belt 26, and transferring a full-color toner image onto the base substance P, (5) fixing the full-color toner image by passing the base substance P through the fixing unit 50, and (6) passing the base substance P through the transfer foil feed unit 70, and discharging out of the apparatus through the eject roller 47.

According to the procedure described above, the image forming apparatus 1 shown in FIG. 5 or the foil image forming unit 3 shown in FIG. 6 enables: forming a foil transferring face H on a base substance P, transferring a foil onto the foil transferring face H thus formed; and forming a full-color image using color toners on the base substance P having thereon the transferred foil.

Figure 7:
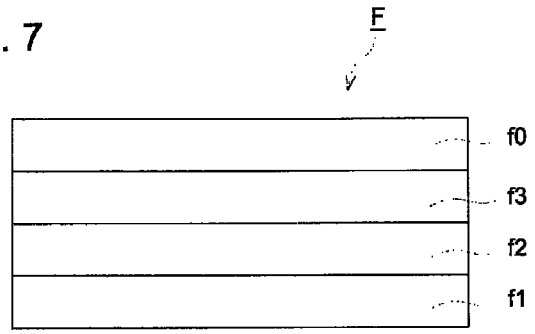
FIG. 7 is a schematic diagram which shows a cross-sectional construction view of a transfer foil.

Next, the transfer foil which can be used in the present invention will be described using FIG. 7. FIG. 7 is a schematic diagram showing a sectional structure of one of the typical transfer foils usable in the present invention. The transfer foil F which can be used in the present invention has at least a film-like support f0 composed of, for example, a resin, a foil layer f2 containing, for example, a colorant or a metal, and an adhesive layer f1 containing an organic material which exhibits an adhesive property. The foil layer f2 and the adhesive layer f1 are transferred onto the base substance P. The adhesive layer f1 is formed on the outermost surface of the transfer foil F, and brought in direct contact with the surface of the base substance P to bond the foil layer f2 strongly onto the surface of the base substance P, when transferred. Further, the transfer foil F shown in FIG. 7 has a release layer f3 between the support f0 and the foil layer f2. Hereafter, each layer of the support f0, foil layer f2 and adhesive layer f1 will be described.

First, the support f0 is a film or a sheet which is composed of, for example, a resin. As a material of the support f0, well-known resin materials, for example, a polyethylene terephthalate (PET) resin, a polyethylene naphthalate (PEN)

resin, a polypropylen (PP) resin, a polyether sulfone resin and a polyimide resin may be cited. Further, it is also possible to use materials such as paper other than these resin materials.

The support f0 may either have a single layer structure or a multi-layer structure. When a multi-layer structure is adopted in the support f0, it is preferable that the support f0 has a release layer f3, which can be used for adjusting peel resistance, on the outermost surface of the support f0 facing the foil layer f2. Examples of a material for the release layer f3 include: a thereto-curable resin employing melamine or isocyanate as a hardener; and a UV curable resin or an electron beam curable resin containing an acrylic resin or an epoxy resin, which is added with a release agent known in the art. Well-known releasing agents applicable to the releasing layer f3 include, for example, fluorine-based or silicone-based monomers or polymers.

The foil layer f2 contains, for example, a colorant or a metallic material, and, after it is transferred onto a base substance P, the foil layer f2 provides an aesthetic appearance. The foil layer f2 is expected to be smoothly released form the support f0 when it is transferred onto the base substance P, while the foil layer f2 is expected, after transferred, to exhibit durability since it forms the outermost surface of the base substance P. The foil layer f2 can be formed by applying a well-known resin which meets the above properties on the support f0 using a coater, for example, a gravure water, a micro-gravure coater or a roll coater. Examples of such a well-known resin include an acrylic resin, a styrene resin and a melamine resin. It is also possible to add a well-known dye or pigment into the resin to provide a color.

When a foil of a finish exhibiting metallic gloss is formed, it is possible to provide the resin with a reflecting layer formed according to a well-known method using, for example, a metal. Examples of a metallic material which forms a reflecting layer include carriers such as aluminum, tin, silver, chromium, nickel and gold. Alloys, for example, a nickel chromium iron alloy, bronze and aluminum bronze are also usable in addition to the above metal carries. Examples of a method to form a reflecting layer using the above metallic materials include well-known methods such as a vacuum evaporation method, a sputtering method and an ion plating method, by which it is possible to form a reflecting layer having a thickness of 10 nm-100 nm. It is also possible to conduct a patterning process to provide a regular pattern using a well-known processing method, such as washing sealant processing, etching processing, and laser beam machining, for example, to a reflecting layer.

The adhesive layer f1 contains a thermo sensitive adhesive agent so called a hot melt adhesive agent, which exhibits an adhesive property when heated. Examples of a thermo sensitive adhesive agent include well known thermoplastic resins usable for a hot melt adhesive agent such as an acrylic resin, a vinyl chloride-vinyl acetate copolymer, an epoxy resin and an ethylene-vinyl alcohol copolymer. These hot melt adhesive agent on the market has a softening temperature of 80° C.-120° C. For a foil transfer adhesive layer, it is preferable to have the softening temperature of 75° C.-105° C., which is used for bookbinding In the present invention, glass transition temperature of the toner which forms foil transferring face H is controlled not more than 60° C., whereby each of the foil transferring face H and the adhesive layer f1 is softened and melted at the same heating temperature. The adhesive layer f1 can be formed by applying an aforementioned resin on a foil layer f2 using a coater, for example, a gravure coater, a micro-gravure coater or a roll coater.

EXAMPLES

Embodiments of the present invention will now be specifically described with the reference to examples, however the present invention is not limited thereto. Incidentally, the expression of "part" referred to in Examples represents "part by mass".

1. Preparation of "Foil Transferring Face Forming Toners A to C" and "Foil Transferring Face Forming Developers A to C"

Three kinds of "Foil Transferring Face Forming Toners A to C" having different glass transition temperature were prepared via the process of preparation for resin microparticles by multi-step polymerization and the process of coagulating and fusing in association method described later. Further, "Foil Transferring Face Forming Developers A to C" were prepared by mixing these "Foil Transferring Face Forming Toners" with resin coated carrier according to the procedure described later.

1-1. Preparation of "Foil Transferring Face Forming Toner A"

(1) Preparation of "Resin Microparticles A2"

As described below, "Resin microparticles A2 was prepared via polymerization reaction in three steps, namely multi-step polymerization method.

(First Step Polymerization)

In a reaction vessel fitted with a stirrer, a temperature sensor, a cooling pipe, and a nitrogen introducing unit, 5 parts by mass of sodium polyoxyethylene-2-dodecyl ether sulfate was added to 800 parts by mass of ion-exchanged water. Liquid temperature was increased to 83° C., while stirring at rotating speed of 230 rpm under nitrogen stream.

After increasing temperature, monomer mixture liquid prepared by dissolving compounds below at 80° C. were added, by employing a mechanical homogenizer "CLEARMIX having circulation loop, produced by M Technique Co., a mixing and dispersing treatment was carried out over 1 hours and emulsion particle dispersion liquid was prepared. Herein, compounds in monomer mixture liquid comprise followings:

| | |
|---|---|
| Styrene | 256 parts by mass |
| n-Butyl acrylate | 73 parts by mass |
| Methacrylic acid | 29 parts by mass |
| n-Octylmercaptan | 5.4 parts by mass |
| Paraffin wax | 113 parts by mass |

Subsequently, a polymerization initiator solution prepared by dissolving 12 parts by mass of potassium persulfate (KPS) in 230 parts by mass of ion-exchanged water was added to the aforesaid emulsion particle dispersion liquid. After addition, polymerization reaction underwent while stirred and heated at 82° C. for 1 hour, whereby dispersion of "Resin microparticles A1" was prepared.

(Second Step Polymerization)

A polymerization initiator solution prepared by dissolving 10 parts by mass of potassium persulfate (KPS) in 200 parts by mass of ion-exchanged water was added to "Resin microparticles A1". After increasing the liquid temperature to 82° C., a polymerizable monomer solution composed of the compounds described below was dripped over 1.5 hours. Herein, mixture of monomers comprise compound below:

| | |
|---|---|
| Styrene | 442 parts by mass |
| n-Butyl acrylate | 102 parts by mass |
| n-Octylmercaptan | 7.5 parts by mass |

After dripping the aforesaid polymerizable monomer solution, a polymerization reaction underwent by heating at 82°

C. and stirring over 2 hours. Thereafter, the temperature was lowered to 28° C., whereby "Resin microparticles A2" was prepared.

(2) Preparation of "Foil Transferring Face Forming Toner A"

(Aggregation and Fusion Process)

Into a reaction vessel fitted with a stirrer, a temperature sensor, a cooling pipe, and a nitrogen introducing unit, placed were:

| | |
|---|---|
| "Resin microparticles A2" | 450 parts by mass (in terms of solids) |
| Ion-exchanged water | 900 parts by mass |

Sodium polyoxyethylene-2-dodecyl ether sulfate 2 parts by mass was added and stirred. After regulating the interior to 25° C., the pH was regulated to 10 by the addition of a 25% by mass of aqueous potassium hydroxide solution.

Subsequently, an aqueous solution, prepared by dissolving 70 parts by mass of magnesium chloride hexahydrate in 105 parts by mass of ion-exchanged water, was added at 30° C. while stirred over 30 minutes. After the addition, the resulting mixture was allowed to stand for 3 minutes, followed by further heating. The temperature of the above system was increased to 87° C. over 60 minutes. Keeping at 87° C., above aggregation and fusion process of "Resin microparticles A2" was continued. Subsequently, the average diameter of aggregated particles was determined via "COULTER MULTISIZER 3 (produced by Beckmann Coulter Co.), and when the volume based median diameter reached to 6.7 μm, an aqueous solution prepared by dissolving 73 parts by mass of sodium chloride in 230 parts by mass of ion-exchanged water was added, and aggregation was terminated.

After terminating aggregation, as a ripening treatment, the liquid temperature was regulated to 88° C., and fusion between Resin microparticles was allowed to continue until an average circularity determined via "FPIA-2100" (produced by Sysmex Corporation.) being 0.960, whereby "Toner mother particle A" was prepared. After ripening treatment, the liquid temperature was cooled to 30° C., and pH of liquid was regulated to 2 by using hydrochloric acid and stop stirring.

Above prepared "Toner mother particle A" was solid-liquid separated by using basket type centrifuge "MARK TII, type 60×40 (produced by Matsumoto Machine Mfg. Co., Ltd.)", whereby a wet cake of "Toner mother particle A" was prepared. The wet cake was washed with ion-exchanged water at 40° C. by using the basket type centrifuge above until an electric conductivity of filtrate reached to 5 μS/cm. After the washing process, drying was carried out by "Flash Jet Dyer (produced by Seishin Enterprise Co., Ltd)" to the water content of 0.5% by mass, whereby "Toner mother particle A" was prepared.

(External Addition Process)

Following external additives were added to 100 parts by mass of prepared "Toner mother particle A", whereby "Foil transferring face forming toner A" was prepared by employing a Henschel mixer (produced by Mitsui Miike Mining Co., Ltd.).

| | |
|---|---|
| Hexamethylsilazane-treated silica (average primary particle diameter of 12 nm, hydrophobized degree of 68) | 1.0 part by mass and |
| n-octylsilane-treated titanium dioxide (average primary particle diameter of 20 nm, hydrophobized degree of 63) | 0.3 part by mass. |

External addition processes were carried out in such a manner that by employing a Henschel mixer, mixing was performed under conditions of a stirring blade peripheral rate of 35 m/second, a processing temperature of 35° C., and a processing period of 15 minutes.

"Foil Transferring Face Forming Toner A" was prepared by employing above procedure. Prepared "Toner A for forming a foil transferring face" had a volumetric basis median size of 6.7 μm, the glass transition temperature determined by the method described above of 52.3° C.

1-2. Preparation of "Foil Transferring Face Forming Toners B and C"

(1) Preparation of"Foil Transferring Face Forming Toner B"

Dispersion of "Resin microparticles B1" was prepared in the same manner as the preparation of "Foil Transferring Face Forming Toner A", except that a content of compounds in the polymerizable monomer solution used in the first step polymerization was changed as follows:

| | |
|---|---|
| Styrene | 260 parts by mass |
| n-Butyl acrylate | 65 parts by mass |
| Methacrylic acid | 33 parts by mass |
| n-Octyl mercaptane | 5.4 parts by mass |
| Paraffin wax | 113 parts by mass |

Further, "Resin microparticles B2" was prepared in the same manner except that a content of compounds in the polymerizable monomer solution used in the second step polymerization was changed as follows:

| | |
|---|---|
| Styrene | 452 parts by mass |
| n-Butyl acrylate | 92 parts by mass |
| n-Octyl mercaptane | 7.5 parts by mass |

Further, "Foil Transferring Face Forming Toner B" was prepared in the same manner, except for changing the dispersion of "Resin microparticles A2" to the dispersion of "Resin microparticles B2" described above. Herein, prepared "Foil Transferring Face Forming Toner B" had a volumetric basis median size of 6.7 μm as same as "Foil Transferring Face Forming Toner A", the glass transition temperature determined by the method described above of 60.0° C.

(2) Preparation of "Foil Transferring Face Forming Toner C"

Dispersion of "Resin microparticles C1" was prepared in the same manner as the preparation of "Foil Transferring Face Forming Toner A", except that a content of compounds in the polymerizable monomer solution used in the first step polymerization was changed as follows:

| | |
|---|---|
| Styrene | 262 parts by mass |
| n-Butyl acrylate | 61 parts by mass |
| Methacrylic acid | 35 parts by mass |
| n-Octyl mercaptane | 5.4 parts by mass |
| Paraffin wax | 113 parts by mass |

Further, "Resin microparticles C2" was prepared in the same manner except that a content of compounds in the polymerizable monomer solution used in the second step polymerization was changed as follows:

| | |
|---|---|
| Styrene | 456 parts by mass |
| n-Butyl acrylate | 88 parts by mass |
| n-Octyl mercaptane | 7.5 parts by mass |

Further, "Foil Transferring Face Forming Toner C" was prepared in the same manner, except for changing the dispersion of "Resin microparticles A2" to the dispersion of "Resin microparticles C2" described above. Herein, prepared "Foil Transferring Face Forming Toner C" had a volumetric basis median size of 6.7 μm as same as "Foil Transferring Face Forming Toner A", the glass transition temperature determined by the method described above of 65.0° C.

1-3. Preparation of "Foil Transferring Face Forming Developers A-C"

Ferrite carrier having volume average particle diameter of 40 μm covered with acryl resin was nixed with "Foil Transferring Face Forming Toners A-C" described above by using V type mixer to prepare "Foil Transferring Face Forming Developers A-C" as two component developers having 6% by mass of toner concentration.

2. Preparation of Transfer Foil for Evaluation and Driving Roller and Follower Roller 2-1. Preparation of "Transfer Foils F1-F5"

As a transfer foil F having the same layer structure as shown in FIG. 7, Gold "Transfer foils F1-F5" were prepared by using the same material as gold foil "BL 2 Gold 2.8" produced by MURATA KIMPAKU CO. LTD, except for adhesive layer f1. As for the adhesive layer f1, employed were hot melt adhesive agents on the market having different softening temperature as shown below.

In preparation of "Transfer foil F1", adhesive layer f1 was formed by employing hot melt adhesive agent for bookbinding "BR-4301" (softening temperature 75° C.) produced by Nissin Chemical Industry Co., Ltd. In preparation of "Transfer foil F2", adhesive layer f1 was formed by employing hot melt adhesive agent for bookbinding "13R-9500" (softening temperature 85° C.) produced by Nissin Chemical Industry Co., Ltd. In preparation of "Transfer foil F3", adhesive layer f1 was formed by employing hot melt adhesive agent for bookbinding "BR-4305" (softening temperature 101° C.) produced by Nissin Chemical Industry Co., Ltd. In preparation of "Transfer foil F4", adhesive layer f1 was formed by employing hot melt adhesive agent for packaging "HN-602" (softening temperature 110° C.) produced by Nissin Chemical Industry Co., Ltd.

Further, "Transfer foil F5" was prepared by using the same material as hologram foil "KP015YPP" produced by MURATA KIMPAKU CO. LTD, except for adhesive layer f1. As for the adhesive layer f1, employed was hot melt adhesive agents for bookbinding "B-9500" (softening temperature 85° C.) produced by Nissin Chemical Industry Co., Ltd.

2-2. Preparation of Driving Roller and Follower Roller

Following rollers were prepared as heating roller and pressuring roller for fixing unit used in digital color multi function peripheral "bizhub C355 (produced by Konica Minolta Business Technologies, Inc.)" modified by the well-known method to conduct foil image formation and foil transfer. As heating rollers used for driving rollers, prepared were following "Driving rollers R10-R 16" and as pressuring rollers used for follower rollers, prepared were following "Follower rollers R20-R23".

(1) Preparation of "Driving Rollers R10-R16"

Heating roller which also functions as driving roller is provided by covering a commercially available fluorine resin PFA (tetrafluoroethylene-perfluomalkylvinyl ether copolymer) with thickness of 20 μm on the surface of cylindrical core metal made of aluminum with outside diameter of 70 mm and thickness of 10 mm by well-known method. "Driving rollers R10-R16" having shape described below are prepared by forming covered layer of the fluorine resin PFA on the surface of the cylindrical core metal made of aluminum which are treated by well-known method.

Five kinds of "Driving rollers R10-R14" having "Inverted crown shape" were prepared by treating the core metal so as to have the outside diameter at longitudinal end Re of 70.00 mm and smaller diameter at other portion than the outside diameter at longitudinal end Re. The portion having the minimum outside diameter in "Driving rollers R10-R14" having "Inverted crown shape" were set at the longitudinal center Rc as shown in FIG. 2*a*. Further, also prepared were "Driving roller R15" having flat shape without changing any outside diameter in longitudinal direction and "Driving roller R16" having "Crown" shape with outside diameter at longitudinal center Rc of 70.00 mm and the minimum outside diameter at longitudinal end Re of 69.50 mm.

Shape, outside diameter at longitudinal end, outside diameter at longitudinal center, and difference between diameters of "Driving rollers R10-R16" were listed in Table 1.

TABLE 1

| No. of Driving Roller | Shape of Driving Roller | Outside diameter at End of Roller (mm) | Outside diameter at Center of Roller (mm) | Difference between diameters (mm) |
|---|---|---|---|---|
| R10 | Inverted crown | 70.00 | 69.98 | −0.02 |
| R11 | Inverted crown | 70.00 | 69.50 | −0.50 |
| R12 | Inverted crown | 70.00 | 69.95 | −0.05 |
| R13 | Inverted crown | 70.00 | 69.80 | −0.20 |
| R14 | Inverted crown | 70.00 | 69.60 | −0.40 |
| R15 | Flat | 70.00 | 70.00 | 0.00 |
| R16 | Crown | 69.50 | 70.00 | +0.50 |

(2) Preparation of "Follower Rollers R20-R23"

Pressuring roller which also functions as follower roller is provided by covering a commercially available silicone rubber with thickness of 3 mm on the surface of cylindrical core metal made of aluminum with outside diameter of 60 mm and thickness of 10 mm by well-known method. "Follower roller R20" was prepared which has flat shape without changing any outside diameter in longitudinal direction. Further, "Follower rollers R21 and R22" having "Crown shape" were prepared by treating the core metal by well-known method so as to have the outside diameter at longitudinal center Rc of 60.00 mm and smaller diameter at other portion than the outside diameter at longitudinal center Rc. Further, "Follower roller R23" having "Inverted crown" shape with outside diameter at longitudinal end Re of 60.00 mm and the minimum outside diameter at longitudinal center Rc of 59.80 mm.

Shape, outside diameter at center of roller in a longitudinal direction, outside diameter at longitudinal end and difference between diameters were listed in Table 2.

TABLE 2

| No. of Follower Roller | Shape of Follower Roller | Outside diameter at End of Roller (mm) | Outside diameter at Center of Roller (mm) | Difference between diameters (mm) |
|---|---|---|---|---|
| R20 | Flat | 60.00 | 60.00 | 0.00 |
| R21 | Crown | 60.00 | 59.95 | +0.05 |

TABLE 2-continued

| No. of Follower Roller | Shape of Follower Roller | Outside diameter at End of Roller (mm) | Outside diameter at Center of Roller (mm) | Difference between diameters (mm) |
|---|---|---|---|---|
| R22 | Crown | 60.00 | 59.80 | +0.20 |
| R23 | Inverted crown | 59.80 | 60.00 | −0.20 |

3. Evaluation (1) "Inventive Examples 1-14" and "Comparative Examples 1-4"

Figure 8:
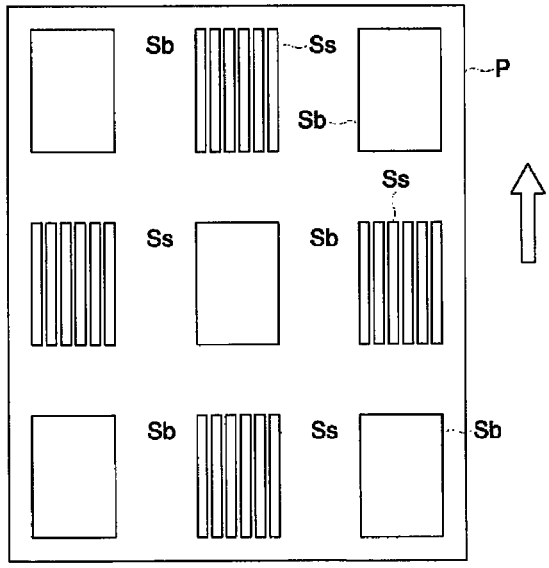
FIG. 8 is a schematic diagram showing a layout of a foil image on an evaluation sample (a printed matter) in Examples.

Above described "Foil transferring face forming toner developers A-C", "Transfer foils F1-F5", "Driving rollers R10-R16" and "Follower roller R20-R23" were installed into the commercially available digital color multi peripheral in combination as listed in Table 3. Herein, the combination in which foil transferring face forming toner and driving roller can satisfy the constitution of the present invention referred to as "Inventive examples 1-14" and the combination in which foil transferring face forming toner and driving miler cannot satisfy the constitution of the present invention referred to as "Comparative examples 1-4".

faces. Herein, at linear foil transferring face, line with 2 mm width were arranged in 1.5 mm interval, in order to confirm a deformation of the foil transferring face caused by heating during foil transfer. Supply amount of toner for forming foil transferring face was set in 4 g/m$^2$. Arrow in FIG. 8 shows a conveyance direction of the base substance.

In the digital color multi peripheral, at first foil transferring face was formed on the base substance P by using the foil transferring face forming toner, followed by transferring the foil on the foil transferring face according to steps shown in FIG. 3. The digital color multi peripheral was modified so as to set surface temperature of heating roller at 135° C. which functioned as driving roller composed of fixing unit and to change conveyance speed of base substance P at nip portion formed between driving roller and follower roller.

Inside of the driving roller (heating roller) and the follower roller (pressuring roller) each, halogen lamp was arranged to control temperature by thermistor. Nip width formed by driving roller and follower roller was set at 9 mm.

(3) Evaluation Items

For one kind of evaluation item, 100 sheets were continuously printed in an environment of ordinary temperatures and humidity (temperature of 20° C., relative humidity of 50% R.H.). With respect to foil images formed on 10th, 50th and

TABLE 3

| | Foil transferring face forming toner | | Transfer foil | | | Driving (heating) roller | | | Follower (pressuring) roller | | | Conveying |
|---|---|---|---|---|---|---|---|---|---|---|---|---|
| | No. | Glass transition temperature (° C.) | No. | Softening temperature (° C.) | Species | No. | Shape | Difference of diameters (mm) | No. | Shape | Difference of diameters (mm) | speed at nip portion (mm/sec) |
| Inv. 1 | A | 52.3 | F2 | 85 | Gold | R13 | *1 | −0.20 | R20 | Flat | 0.00 | 135 |
| Inv. 2 | A | 52.3 | F2 | 85 | Gold | R13 | *1 | −0.20 | R21 | Crown | +0.05 | 135 |
| Inv. 3 | B | 60.0 | F1 | 75 | Gold | R13 | *1 | −0.20 | R20 | Flat | 0.00 | 135 |
| Inv. 4 | B | 60.0 | F1 | 75 | Gold | R13 | *1 | −0.20 | R20 | Flat | 0.00 | 100 |
| Inv. 5 | B | 60.0 | F4 | 110 | Gold | R13 | *1 | −0.20 | R20 | Flat | 0.00 | 135 |
| Inv. 6 | A | 52.3 | F1 | 75 | Gold | R13 | *1 | −0.20 | R20 | Flat | 0.00 | 400 |
| Inv. 7 | A | 52.3 | F1 | 75 | Gold | R10 | *1 | −0.02 | R20 | Flat | 0.00 | 135 |
| Inv. 8 | A | 52.3 | F1 | 75 | Gold | R11 | *1 | −0.50 | R20 | Flat | 0.00 | 135 |
| Inv. 9 | A | 52.3 | F3 | 100 | Gold | R13 | *1 | −0.05 | R20 | Flat | 0.00 | 200 |
| Inv. 10 | A | 52.3 | F4 | 110 | Gold | R14 | *1 | −0.40 | R20 | Flat | 0.00 | 135 |
| Inv. 11 | A | 52.3 | F3 | 100 | Gold | R13 | *1 | −0.22 | R22 | Crown | +0.20 | 200 |
| Inv. 12 | A | 52.3 | F2 | 80 | Gold | R13 | *1 | −0.23 | R23 | *1 | −0.20 | 135 |
| Inv. 13 | A | 52.3 | F5 | 85 | Hologram | R13 | *1 | −0.20 | R20 | Flat | 0.00 | 135 |
| Inv. 14 | B | 60.0 | F5 | 85 | Hologram | R13 | *1 | −0.20 | R20 | Flat | 0.00 | 135 |
| Comp. 1 | C | 65.0 | F4 | 110 | Gold | R13 | *1 | −0.20 | R20 | Flat | 0.00 | 100 |
| Comp. 2 | A | 52.3 | F2 | 85 | Gold | R15 | Flat | 0.00 | R20 | Flat | 0.00 | 135 |
| Comp. 3 | A | 52.3 | F2 | 85 | Gold | R16 | Crown | +0.50 | R22 | Crown | +0.20 | 135 |
| Comp. 4 | A | 52.3 | F5 | 85 | Hologram | R15 | Flat | 0.00 | R20 | Flat | 0.00 | 135 |

*1: Inverted crown
Inv.: Inventive example,
Comp.: Comparative example (2) Evaluation Conditions Following evaluation conditions were applied for evaluation of "Inventive examples 1-14" and "Comparative examples 1-4". Commercially available B4 size image support "OK Top coat+ (weight: 157 g/m$^2$, thickness: 131 μm) (produced by OH PAPER)" was used as the foil image forming base substance.

Evaluation sample (printed matter) had a layout as shown in FIG. 8 in which formed were solid foil transferring faces at four corners and center of base substance P, and linear foil transferring faces between the solid foil transferring faces, and then formed were solid foil image Sb and linear foil image Ss by transferring a foil onto these foil transferring 100th printed matter, evaluated were with or without of occurring wrinkle and adhesion of transfer foil on the formed foil image.

(Wrinkle)

With respect to 10th, 50th and 100th printed matter, foil images formed on 5 solid foil transferring faces on printed matter were observed visually by employing a loupe having a magnification of 10 times. Wrinkles were evaluated by classifying according to the following evaluation ranks. A and B were considered to be acceptable.

A: Wrinkle was not observed in all foil images by both megascopic inspection and inspection employing a loupe, B: Slight wrinkle was observed in foil images by inspection employing a loupe, however, since it was too slight level to be observed by careful megascopic inspection, it was judged to be practically non-problematic.

C: Wrinkle was observed in foil images by megascopic inspection, and was judged to be practically problematic.

(Adhesion of Transfer Foil)

With respect to 10th, 50th and 100th printed matter, a sticking tape was adhered on 5 solid foil images and then peeled by hand. The adhesion condition of each foil image was observed visually by employing a loupe having a magnification of 10 times. In this evaluation, "Scotch mending tape MP-18 (produced by SUMITOMO 3M, Limited)" available on the market was used. Ranks A and B were considered to be acceptable.

A: No minute peeling was observed in all solid foil images by inspection employing a loupe.

B: Minute peeling was observed in all solid foil images by inspection employing a loupe, however, since it was too slight level to be observed by careful megascopic inspection, it was judged to be practically non-problematic.

C: One or more peel of foil was observed, and was judged to be practically problematic.

Results were listed in Table 4.

TABLE 4

| | Wrinkle | | | Adhesion | | |
|---|---|---|---|---|---|---|
| | 10th sheet | 50th sheet | 100th sheet | 10th sheet | 50th sheet | 100th sheet |
| Inv. 1 | A | A | A | A | A | A |
| Inv. 2 | A | A | A | A | A | A |
| Inv. 3 | A | A | A | A | A | B |
| Inv. 4 | A | A | A | A | A | A |
| Inv. 5 | A | A | A | A | A | B |
| Inv. 6 | A | A | B | A | B | B |
| Inv. 7 | A | B | B | A | A | A |
| Inv. 8 | A | B | B | A | A | A |
| Inv. 9 | A | A | A | A | B | B |
| Inv. 10 | A | A | A | A | B | B |
| Inv. 11 | A | A | A | A | A | B |
| Inv. 12 | A | A | B | A | A | A |
| Inv. 13 | A | A | A | A | A | A |
| Inv. 14 | A | A | A | A | B | B |
| Comp. 1 | A | A | A | C | C | C |
| Comp. 2 | C | C | C | A | A | A |
| Comp. 3 | C | C | C | A | A | A |
| Comp. 4 | C | C | C | A | A | A |

As shown in Table 4, in evaluation of the solid foil image, it was confirmed that each of "Inventive examples 1 to 14", in which printed matter was formed by using the constitutions of the present invention, did not cause wrinkle and exhibited enough adhesion for practical use. On the other hand, among "Comparative examples 1 to 4" in which printed matter was formed by without satisfying constitution of the present invention, it was confirmed that enough properties such as performed by using "Inventive examples 1 to 14"could not be realized.

What is claimed is:

1. An image forming method comprising at least steps of:

(a) forming an electrostatic latent image by exposing a photoreceptor, (b) forming a foil transferring face by supplying a toner onto the photoreceptor having the electrostatic latent image, (c) transferring the foil transferring face formed on the photoreceptor through an intermediate transfer belt or directly to a base substance, (d) fixing the foil transferring face transferred on the base substance, (e) feeding a transfer foil to the base substance having the fixed foil transferring face, and (f) transferring the transfer foil to the foil transferring face by heating the transfer foil while contacting the transfer foil with the foil transferring face, wherein a toner for forming the foil transferring face has a glass transition temperature of not more than 60° C., the transfer is transferred to the foil transferring face by heating the transfer foil and the foil transferring face while passing through a nip portion formed between a driving roller and a follower roller in the step of (f), an outside diameter at a longitudinal end of the driving roller is larger than an outside diameter at other than the longitudinal end of the driving roller, and a difference between the outside diameter at the longitudinal end of the driving roller and a minimum outside diameter in a longitudinal direction of the driving roller is not less than 0.05 mm and not more than 0.40 mm.

2. The image forming method of claim 1, wherein the follower roller has an outside diameter at a longitudinal end being smaller than an outside diameter at other than the longitudinal end or the same outside diameter in a longitudinal direction.

3. The image forming method of claim 2, wherein a difference between the outside diameter at the longitudinal end of the follower roller and a maximum outside diameter in a longitudinal direction of the follower roller is not more than 0.20 mm, when the follower roller has an outside diameter at a longitudinal end being smaller than an outside diameter at other than the longitudinal end.

4. The image forming method of claim 1, wherein the base substance on which the transfer foil and the foil transferring face are fixed passes through a nip portion formed between a driving roller and a follower roller at a speed of not less than 100 mm/second and not more than 400 mm/second.

5. The image forming method of claim 1, wherein the foil has an adhesion layer having a softening transfer temperature of not less than 75° C. and not, more than 105° C.

6. The image forming method of claim 1, wherein at least one of the driving roller and the follower roller has a heating member.

7. An image forming apparatus comprising at least members of:

a photoreceptor which forms an electrostatic latent image by exposing by an exposing member, foil transferring face forming member which forms a foil transferring face by supplying is toner onto the photoreceptor having the electrostatic latent image, a foil transferring face transferring member which transfers the foil transferring face formed on the photoreceptor through an intermediate transfer belt or directly to a base substance, a fixing member which fixes the foil transferring face transferred on the base substance, a transfer foil feeding member which supplies a transfer foil to the base substance having the fixed foil transferring face, and a transfer foil transferring member which transfers the transfer foil to the foil transferring face by heating the transfer foil while contacting the transfer foil with the foil transferring face, wherein a toner supplied by the foil transferring face forming member has a glass transition temperature of not more than 60°C., the transfer foil transferring member has a driving roller and a following roller wherein the driving roller has an outside diameter at a longitudinal end larger than an outside diameter at other than the longitudinal end, a difference between the outside diameter at the longitudinal end of the driving roller and a minimum outside diameter in a longitudinal direction of the driving roller is not less than 0.05 mm and not more than 0.40 mm, and the transfer foil transferring member transfers the transfer foil to the foil transferring face by heating the transfer foil and the foil transferring face while passing through a nip portion formed between a driving roller and a follower roller.

8. The image forming apparatus of claim 7, wherein the follower roller has an outside diameter at a longitudinal end being smaller than an outside diameter at other than the longitudinal end or the same outside diameter in a longitudinal direction.

9. The image forming apparatus of claim 8, wherein a difference between the outside diameter at the longitudinal end of the follower roller and a maximum outside diameter in a longitudinal direction of the follower roller is not more than 0.20 mm, when the follower roller has an outside diameter at a longitudinal end being smaller than an outside diameter at other than the longitudinal end.

10. The image forming apparatus of claim 7, wherein the base substance on which the transfer foil and the foil transferring face are fixed passes through a nip portion formed between a driving roller and a follower roller at a speed of not less than 100 mm/second and not more than 400 mm/second.

11. The image forming apparatus of claim 7, wherein the transfer foil has an adhesion layer having a softening temperature of not less than 75° C and not more than 105°C.

12. The image forming apparatus of claim 7, wherein at least one of the driving roller and the follower roller has a heating member.

13. The image forming method of claim 1, wherein the driving roller is brought into contact with the transfer foil in the step (f).

* * * * *